US008738171B2

(12) United States Patent
Kato et al.

(10) Patent No.: US 8,738,171 B2
(45) Date of Patent: May 27, 2014

(54) SEWING MACHINE AND NON-TRANSITORY COMPUTER-READABLE MEDIUM

(71) Applicants: Harumi Kato, Nagoya (JP); Midori Magara, Nagoya (JP); Katsuhisa Hasegawa, Kasugai (JP)

(72) Inventors: Harumi Kato, Nagoya (JP); Midori Magara, Nagoya (JP); Katsuhisa Hasegawa, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/624,420

(22) Filed: Sep. 21, 2012

(65) Prior Publication Data

US 2013/0074749 A1 Mar. 28, 2013

(30) Foreign Application Priority Data

Sep. 28, 2011 (JP) ..... 2011-213137

(51) Int. Cl.
*D05B 21/00* (2006.01)

(52) U.S. Cl.
USPC ..... 700/138; 112/102.5

(58) Field of Classification Search
USPC ..... 700/136–138; 112/102, 102.5, 103, 112/118, 119
See application file for complete search history.

(56) References Cited

U.S. PATENT DOCUMENTS 674,014 A * 5/1901 Parkes ..... 112/103
1,120,357 A 12/1914 Austin
2,989,015 A 6/1961 Taketomi
4,247,998 A 2/1981 Foss
4,411,208 A 10/1983 Nishida et al.
4,422,250 A 12/1983 Golan
4,598,655 A 7/1986 Takenoya
4,762,076 A * 8/1988 Wakaizumi ..... 112/103
4,774,778 A 10/1988 Williams
4,849,902 A * 7/1989 Yokoe et al. ..... 112/470.04
4,943,906 A * 7/1990 Tajima et al. ..... 700/83
4,998,489 A * 3/1991 Hisatake et al. ..... 112/103
5,144,899 A 9/1992 Allen (Continued)

FOREIGN PATENT DOCUMENTS

JP A 59-181185 10/1984
JP A 03-193090 8/1991

(Continued)

OTHER PUBLICATIONS

Dec. 19, 2012 Office Action issued in U.S. Appl. No. 13/624,336.

(Continued)

*Primary Examiner* — Danny Worrell
(74) *Attorney, Agent, or Firm* — Oliff PLC

(57) ABSTRACT

A sewing machine may comprise a mounting portion configured to be mounted with an embroidery frame comprising a frame and an outer frame. The sewing machine may also comprise an image capturing device configured to capture an image including the embroidery frame mounted on the mounting portion. The sewing machine may further comprise a processor configured to execute instructions, and a memory. The memory may be configured to store computer-readable instructions that instruct the sewing machine to execute steps comprising identifying a mark from the captured image, wherein the mark is provided on the embroidery frame or on a work cloth held by the embroidery frame, determining a rotation angle of the frame with respect to the outer frame based on the identified mark, and notifying rotation information based on the determined rotation angle. The rotation information may be information for adjusting the rotation angle to a specified rotation angle.

8 Claims, 14 Drawing Sheets

(56) References Cited

U.S. PATENT DOCUMENTS

| | | | | | |
|---|---|---|---|---|---|
| 5,151,863 | A * | 9/1992 | Komuro et al. | 700/138 |
| 5,191,536 | A * | 3/1993 | Komuro et al. | 700/138 |
| 5,222,314 | A | 6/1993 | Inteso | |
| 5,261,341 | A * | 11/1993 | Asano | 112/102.5 |
| 5,377,605 | A * | 1/1995 | Frye | 112/114 |
| 5,427,043 | A * | 6/1995 | Conley et al. | 112/102.5 |
| 5,555,828 | A * | 9/1996 | Rowley | 112/103 |
| 5,632,214 | A * | 5/1997 | Conley et al. | 112/470.06 |
| 5,860,374 | A * | 1/1999 | Jensen et al. | 112/102.5 |
| 5,911,182 | A * | 6/1999 | Uyama et al. | 112/102.5 |
| 5,970,895 | A | 10/1999 | Mack | |
| 6,000,350 | A * | 12/1999 | Koike et al. | 112/102.5 |
| 6,095,068 | A * | 8/2000 | Hori | 112/103 |
| 6,119,611 | A * | 9/2000 | Tomita | 112/470.04 |
| 6,167,822 | B1 * | 1/2001 | Miyasako et al. | 112/102.5 |
| 6,298,800 | B1 * | 10/2001 | Gala | 112/103 |
| 7,168,378 | B2 * | 1/2007 | Fukao | 112/103 |
| 7,302,308 | B2 * | 11/2007 | Kato et al. | 700/138 |
| 7,359,760 | B2 * | 4/2008 | Kishi et al. | 700/138 |
| 7,542,822 | B2 * | 6/2009 | Kawaguchi et al. | 700/138 |
| 7,561,939 | B2 * | 7/2009 | Kawabe et al. | 700/138 |
| 8,301,292 | B2 * | 10/2012 | Tokura | 700/138 |
| 8,438,984 | B2 * | 5/2013 | Hasegawa et al. | 112/103 |
| 2005/0234585 | A1 * | 10/2005 | Muto et al. | 700/138 |
| 2006/0167581 | A1 * | 7/2006 | Kawaguchi et al. | 700/138 |
| 2007/0225855 | A1 * | 9/2007 | Yamada | 700/138 |
| 2008/0216721 | A1 * | 9/2008 | Nagai et al. | 112/102.5 |
| 2009/0188413 | A1 * | 7/2009 | Hirata et al. | 112/103 |
| 2009/0188414 | A1 * | 7/2009 | Tokura | 112/457 |

FOREIGN PATENT DOCUMENTS

| | | |
|---|---|---|
| JP | A 05-123464 | 5/1993 |
| JP | U 06-004094 | 1/1994 |
| JP | A 2002-136784 | 5/2002 |

OTHER PUBLICATIONS

U.S. Appl. No. 13/624,350, filed Sep. 21, 2012.
U.S. Appl. No. 13/623,542, filed Sep. 20, 2012.
U.S. Appl. No. 13/624,336, filed Sep. 21, 2012.
U.S. Appl. No. 13/624,350, filed Sep. 20, 2012.
Aug. 30, 2013 Office Action issued in U.S. Appl. No. 13/624,350.
Sep. 17, 2013 Office Action issued in U.S. Appl. No. 13/623,542.

* cited by examiner

FIG. 9

59

| VARIABLE N | FRAME ROTATION DATA | X COORDINATE | Y COORDINATE |
|---|---|---|---|
| 1 | +44° | 27 | 9 |
| 2 | +44° | 27 | 8 |
| ⋮ | ⋮ | ⋮ | ⋮ |
| 38 | +44° | -27 | -9 |
| 39 | 0° | 10 | 5 |
| 40 | 0° | 9 | 4 |
| ⋮ | ⋮ | ⋮ | ⋮ |
| 221 | -44° | -28 | 9 |

PLEASE ROTATE THE EMBROIDERY FRAME
TARGET ROTATION ANGLE: +44
CURRENT ROTATION ANGLE: 0

PLEASE ROTATE THE EMBROIDERY FRAME
TARGET ROTATION ANGLE: +44
CURRENT ROTATION ANGLE: +20

PLEASE ROTATE THE EMBROIDERY FRAME
TARGET ROTATION ANGLE: +44
CURRENT ROTATION ANGLE: +44
ROTATION ANGLE MATCHES TARGET ROTATION ANGLE

SEWING MACHINE AND NON-TRANSITORY COMPUTER-READABLE MEDIUM

CROSS-REFERENCE TO RELATED APPLICATION

This application claims priority to Japanese Patent Application No. 2011-213137, filed on Sep. 28, 2011, the disclosure of which is hereby incorporated by reference herein in its entirety.

BACKGROUND

This disclosure relates to a sewing machine and a computer-readable medium. The sewing machine is configured such that en embroidery frame is detachably attachable to the sewing machine. The computer-readable medium stores a program for the sewing machine.

A sewing machine is widely known that is configured to sew am embroidery pattern using an embroidery frame. The embroidery frame is a circular form. The embroidery frame is configured to be rotatable to an intended angle. For example, the embroidery frame that comprises a pair of embroidery frames and an outer frame is configured to be attachable to the sewing machine. The pair of embroidery frames comprises a small embroidery frame and a big embroidery frame. The small embroidery frame is a circular form and the big embroidery frame is also a circular form. An inner diameter of the big embroidery frame is longer than an outer diameter of the small embroidery frame. A work cloth can be held between the small embroidery frame and the big embroidery frame. The outer frame can hold the pair of embroidery frames such that the pair of embroidery frames is rotatable. A fixation screw is provided on a side face of the outer embroidery frame. A triangular mark is provided on an upper face of the big embroidery frame and a plurality of scale marks indicative of angles are provided on the outer embroidery frame. The pair of embroidery frames can be rotated to the intended angle with respect to the outer embroidery frame by a user of the sewing machine, as the user looks at the triangular mark and the plurality of scale marks. After rotating, the fixation screw can be tightened by the user. In this manner, the pair of embroidery frames can be fixed to the outer embroidery frame.

SUMMARY

When the embroidery frame as described above is used by the user, the user has to adjust the pair of embroidery frames with respect to the outer embroidery frame, as the user looks at the triangular mark and the plurality of scale marks. In that case, the triangular mark or the scale mark may be covered by the work cloth. As a result, it may be difficult for the user to see the triangular mark or the scale mark. Alternatively, it may be difficult to increase accuracy of adjusting the angle, because the user has to adjust the pair of embroidery frames with respect to the outer embroidery frame by visually checking the triangular mark and the scale mark.

Various exemplary embodiments of the general principles herein provide a sewing machine and a non-transitory computer-readable medium which allows a user to adjust the angle of an embroidery frame easily.

Exemplary embodiments herein provide a sewing machine that comprises a mounting portion, an image capturing device, a processor, and a memory. The mounting portion may be configured to be mounted with an embroidery frame. The embroidery frame may comprise a frame configured to hold a work cloth and an outer frame configured to be detachably attached to an outside of the frame and configured to rotatably hold the frame. The image capturing device may be configured to capture an image including the embroidery frame mounted on the mounting portion. The processor may be configured to execute instructions. The memory may be configured to store computer-readable instructions therein, wherein the computer-readable instructions instruct the sewing machine to execute steps comprising identifying a mark from the image captured by the image capturing device, wherein the mark is provided on the embroidery frame or on the work cloth held by the embroidery frame, determining a rotation angle of the frame with respect to the outer frame based on the identified mark, and notifying rotation information based on the determined rotation angle. The rotation information may be information for adjusting the rotation angle to a specified rotation angle.

Exemplary embodiments also provide a non-transitory computer-readable medium storing computer-readable instructions that, when executed, instruct a sewing machine. The sewing machine may comprise a mounting portion and an image capturing device. The mounting portion may be configured to be mounted with an embroidery frame. The embroidery frame may comprise a frame configured to hold a work cloth and an outer frame configured to be detachably attached to an outside of the frame and configured to rotatably hold the frame. The image capturing device may be configured to capture an image including the embroidery frame mounted on the mounting portion. The computer-readable instructions may instruct the sewing machine to execute steps comprising identifying a mark from the image captured by the image capturing device, wherein the mark is provided on the embroidery frame or on the work cloth held by the embroidery frame, determining a rotation angle of the frame with respect to the outer frame based on the identified mark, and notifying rotation information based on the determined rotation angle. The rotation information may be information for adjusting the rotation angle to a specified rotation angle.

BRIEF DESCRIPTION OF THE DRAWINGS

Exemplary embodiments of the present disclosure will be described below in detail with reference to the accompanying drawing in which:

FIG. 9 is a diagram of a data configuration of a outwork data table 59;

DETAILED DESCRIPTION

Figure 1:
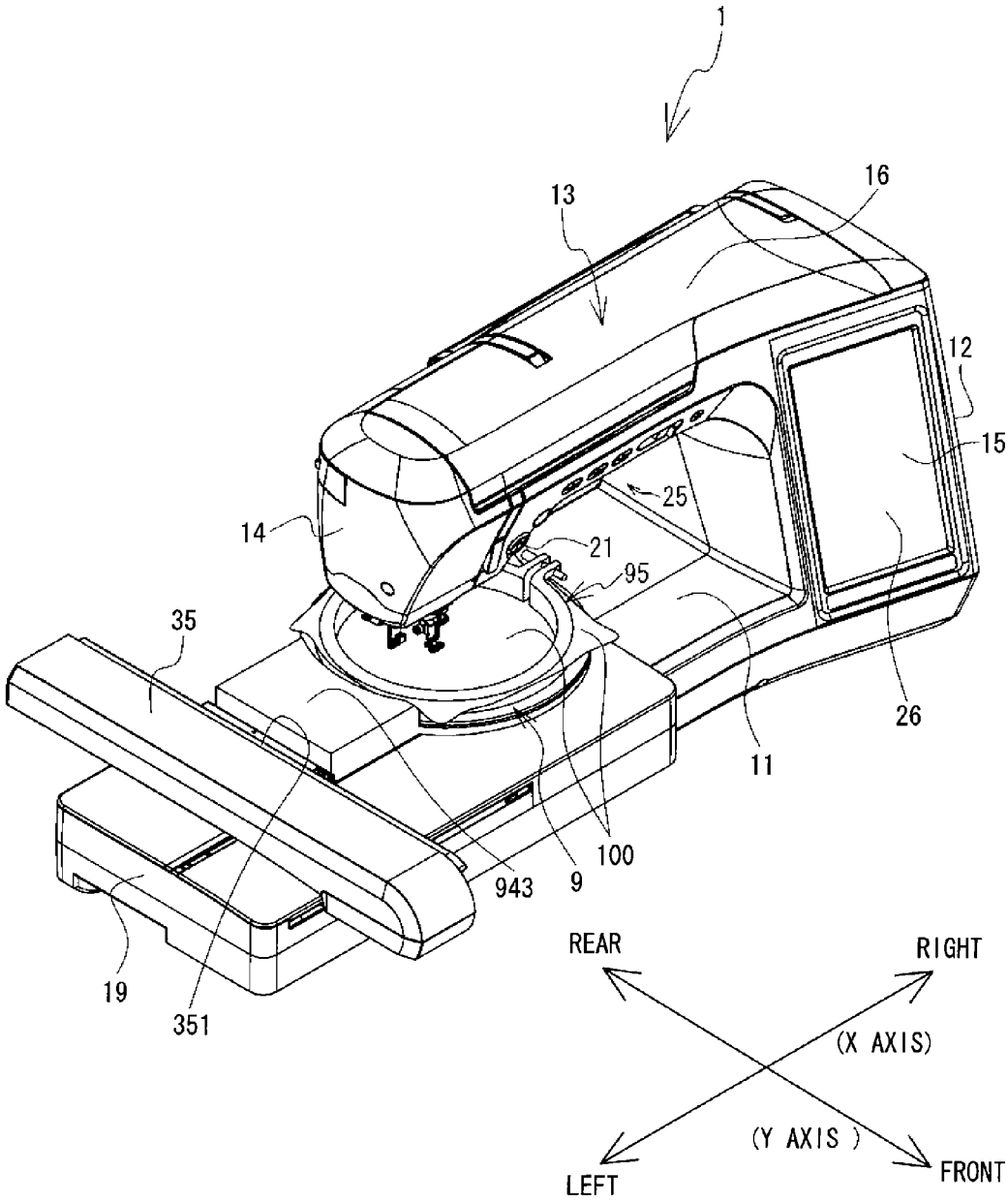
FIG. 1 is en oblique view of a sewing machine 1 on which an embroidery frame 9 is mounted.

Hereinafter, an embodiment of the present disclosure will be explained with reference to the drawings. A configuration of a sewing machine 1 will be explained with reference to FIGS. 1 and 2. In FIG. 1, the side where a user of the sewing machine 1 is positioned is defined as the front side of the sewing machine 1, and the opposite side is defined as the rear side. The left-right direction as seen by the user is defined as the left-right direction of sewing machine 1. That is the face of the sewing machine 1 on which a switch cluster 25 that will be described later is provided is the front face of the sewing machine 1. The longitudinal direction of a bed 11 and an arm 13 are the left-right direction of the sewing machine 1, and a side on which a pillar 12 is positioned is the right side of the sewing machine 1. A direction in which the pillar 12 extends is the up-down direction of the sewing machine 1.

As shown in FIG. 1, the sewing machine 1 includes a bed 11, a pillar 12, an arm 13, and a head 14. The bed 11 is a base portion of the sewing machine 1 and extends in the left-right direction. The pillar 12 extends upward from the right end of the bed 11. The arm 13 extends to the left from the upper end of the pillar 12. The head 14 is provided on the left end of the arm 13. A needle plate (not shown in the drawings) is provided in the top face of the bed 11. A feed dog (not shown in the drawings), a cloth feed mechanism (not shown in the drawings), a feed adjustment pulse motor 78 (refer to FIG. 8), and a shuttle mechanism (not shown in the drawings) are provided within the bed 11, underneath the needle plate. The feed dog may feed, by a specified feed amount, a work cloth on which sewing is performed. The cloth feed mechanism may drive the feed dog. The feed adjustment pulse motor 78 may adjust the feed amount.

In a case where embroidery sewing is performed with the sewing machine 1, an embroidery frame 9, which holds a work cloth 100, may be disposed on the top side of the bed 11. An area inside the embroidery frame 9 is an embroidery area in which stitches of an embroidery pattern can be formed. A moving unit 19 that is configured to move the embroidery frame 9 may be removably mounted on the bed 11. A carriage cover 35, which extends in the front-rear direction, is provided on the upper part of the moving unit 19. A Y axis moving mechanism (not shown in the drawings) is provided inside the carriage cover 35. The Y axis moving mechanism is configured to move a carriage (not shown in the drawings) in a Y axis direction (the front-rear direction of the sewing machine 1). The embroidery frame 9 may be removably mounted on the carriage. A mounting portion 351, on which the embroidery frame 9 can be mounted, is provided on the right side of the carriage. The mounting portion 351 projects to the right from the right side face of the carriage cover 35. An attachment portion 942 (refer to FIG. 4) that is provided on the embroidery frame 9 may be mounted on the mounting portion 351. The carriage, the Y axis moving mechanism, and the carriage cover 35 may be moved in an X axis direction (the left-right direction of the sewing machine 1) by an X axis moving mechanism (not shown in the drawings). The X axis moving mechanism is provided inside the body of the moving unit 19.

Figure 8:
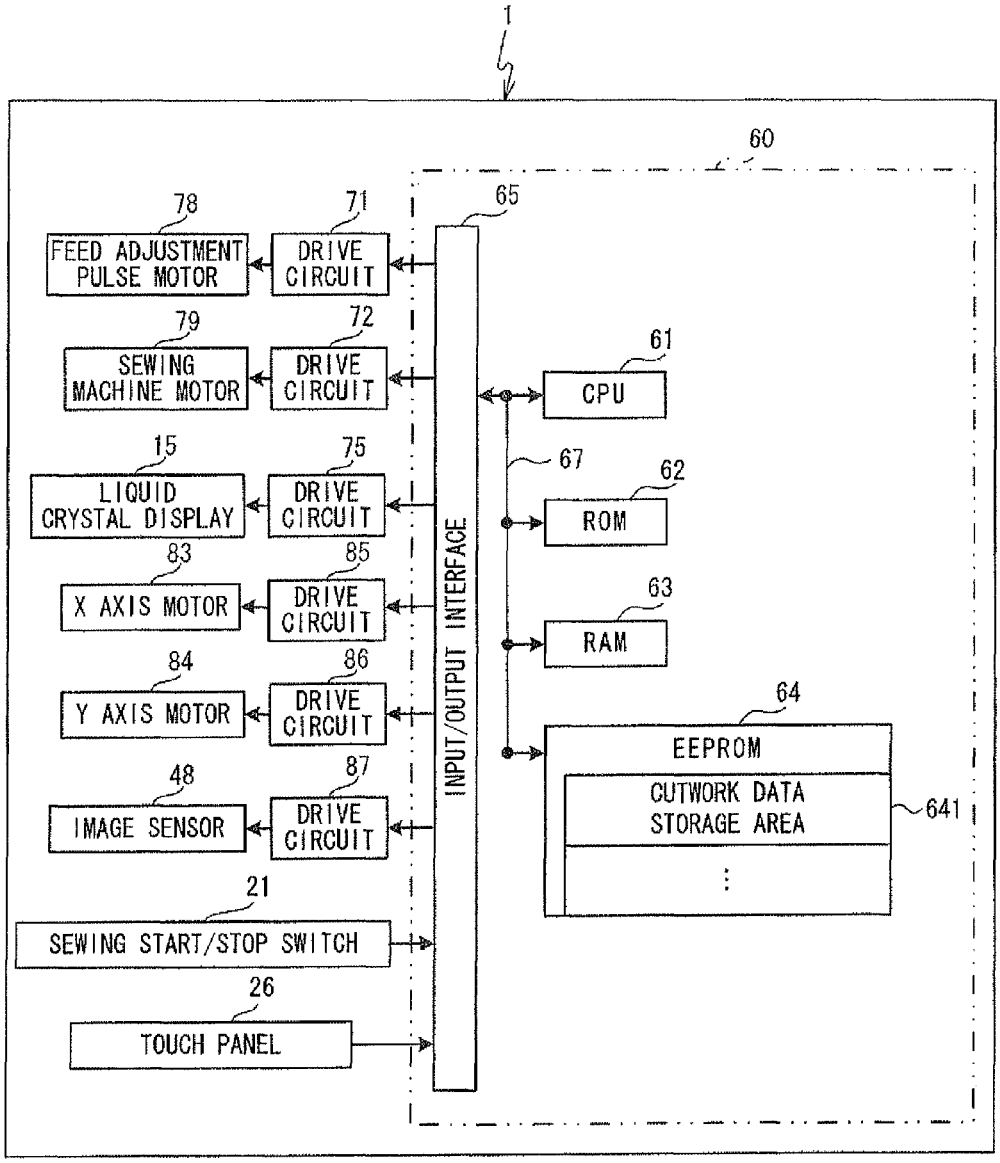
FIG. 8 is a block diagram that shows an electrical configuration of the sewing machine 1.

The X axis moving mechanism and the Y axis moving mechanism may be respectively driven by an X axis motor 83 (refer to FIG. 8) and a Y axis motor 84 (refer to FIG. 8). A needle bar 6 (refer to FIG. 2) and the shuttle mechanism (not shown in the drawings) may be driven as the embroidery frame 9 is moved in the X axis direction and the Y axis direction. In this manner, an embroidery sewing operation that sews a specified embroidery pattern or the like in the work cloth 100 that is held by the embroidery frame 9 and a cutwork operation that forms cuts in the work cloth 100 in a specified shape may be performed. In a case where an ordinary pattern, which is not an embroidery pattern, is sewn, the moving unit 19 may be removed from the bed 11. Then ordinary sewing may be performed as the work cloth 100 is moved by the feed dog.

A vertically rectangular liquid crystal display 15 is provided on the front face of the pillar 12. Images of various types of items, such as a plurality of types of patterns, names of commands that cause various types of functions to be performed, various types of messages, images that have been captured by an image sensor 48 (refer to FIG. 2), and the like, may be displayed on the liquid crystal display 15. A transparent touch panel 26 is provided on the front face of the liquid crystal display 15. Using a finger or a special touch pen, the user may perform a pressing operation on the touch panel 26. Hereinafter, this operation is referred to as a panel operation. The touch panel 26 may detect a position that is pressed by a finger or a special touch pen etc., and the sewing machine 1 may determine the item that corresponds to the detected position. Thus, the sewing machine 1 may recognize the selected item. By performing the panel operation, the user can select a pattern to be sewn or a command to be executed.

The structure of the arm 13 will be explained. An cover 16 is provided in the top part of the arm 13. The cover 16 is axially supported such that the cover 16 can be opened and dosed by being rotated about an axis that extends in the left-right direction at the upper rear edge of the arm 13. Underneath the cover 16, that is, in the interior of the arm 13, a thread container portion (not shown in the drawings) is provided that may contain a thread spool (not shown in the drawings) that supplies an upper thread. The upper thread may be supplied from the thread spool to a sewing needle 7 (refer to FIG. 2) through a thread hook portion that includes a tensioner, a thread take-up spring, and a thread take-up lever, which are not shown in the drawings. The tensioner is provided in the head 14 and configured to adjust the thread tension. The thread take-up lever may be driven reciprocally up and down and pull the upper thread upward. The sewing needle 7 may be attached to the needle bar 6 (refer to FIG. 2). The needle bar 6 may be moved up and down by a needle bar up-and-down moving mechanism (not shown in the drawings), which is provided inside the head 14. The needle bar up-and-down moving mechanism may be driven by a drive shaft (not shown in the drawings) that is rotationally driven by a sewing machine motor 79 (refer to FIG. 8). In other words, the needle bar 6 may be driven by the sewing machine motor 79.

A switch cluster 25 is provided in the lower part of the front face of the arm 13. The switch cluster 25 includes a sewing start/stop switch 21. The sewing start/stop switch 21 may be used to start or stop the operation of the sewing machine 1. That is, the sewing start/stop switch 21 may be used by the user to issue commands to start or stop the sewing.

Figure 2:
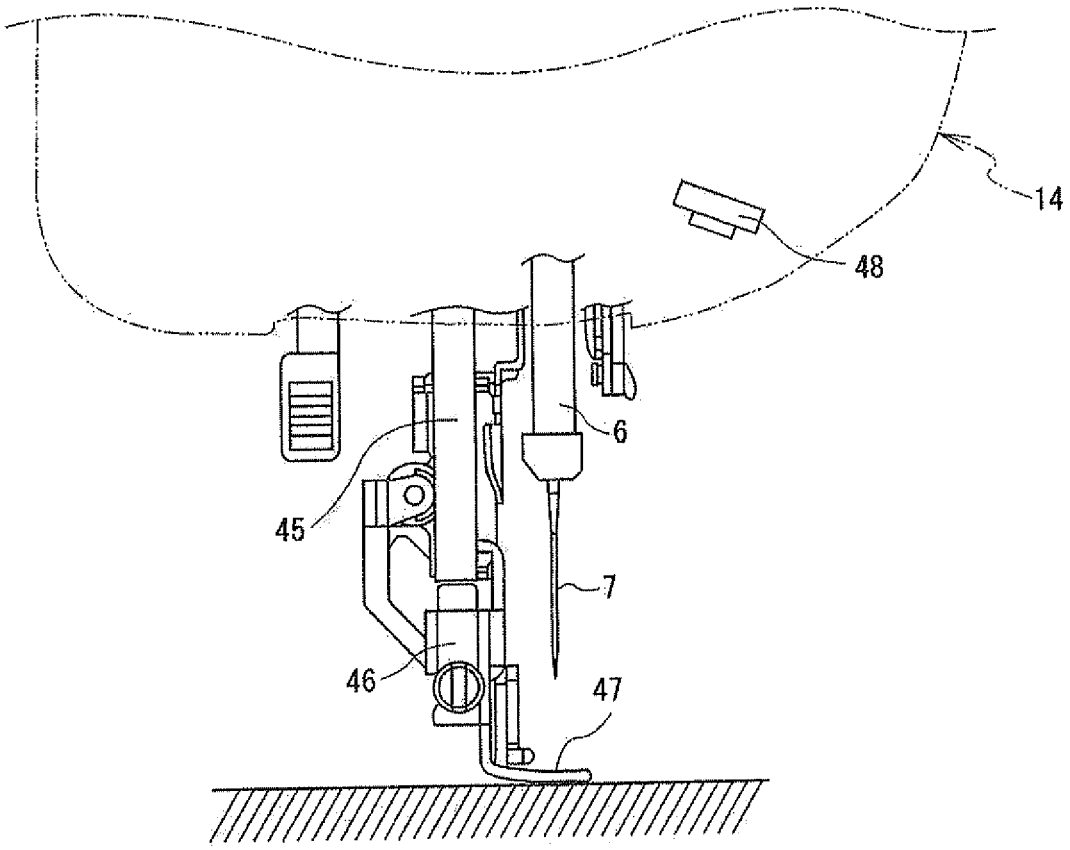
FIG. 2 is a figure that shows a needle bar 6 to which a sewing needle 7 is attached, and an area around the needle bar 6, as seen from the left side of the sewing machine 1.

As shown in FIG. 2, the needle bar 6 is provided in the lower portion of the head 14. One of the sewing needle 7 (refer to FIG. 2) and a outwork needle 8 (refer to FIG. 3) can be attached to the lower end of the needle bar 6. A presser bar 45 is provided to the rear of the needle bar 6. A presser holder 46 may be attached to the lower end of the presser bar 45. A presser foot 47, which may press down on the work cloth 100, may be fixed to the presser holder 46. The image sensor 48 is provided inside the head 14. The image sensor 48 is configured to capture an image of an area that includes the embroidery frame 9 that is mounted on the mounting portion 351.

Figure 3:
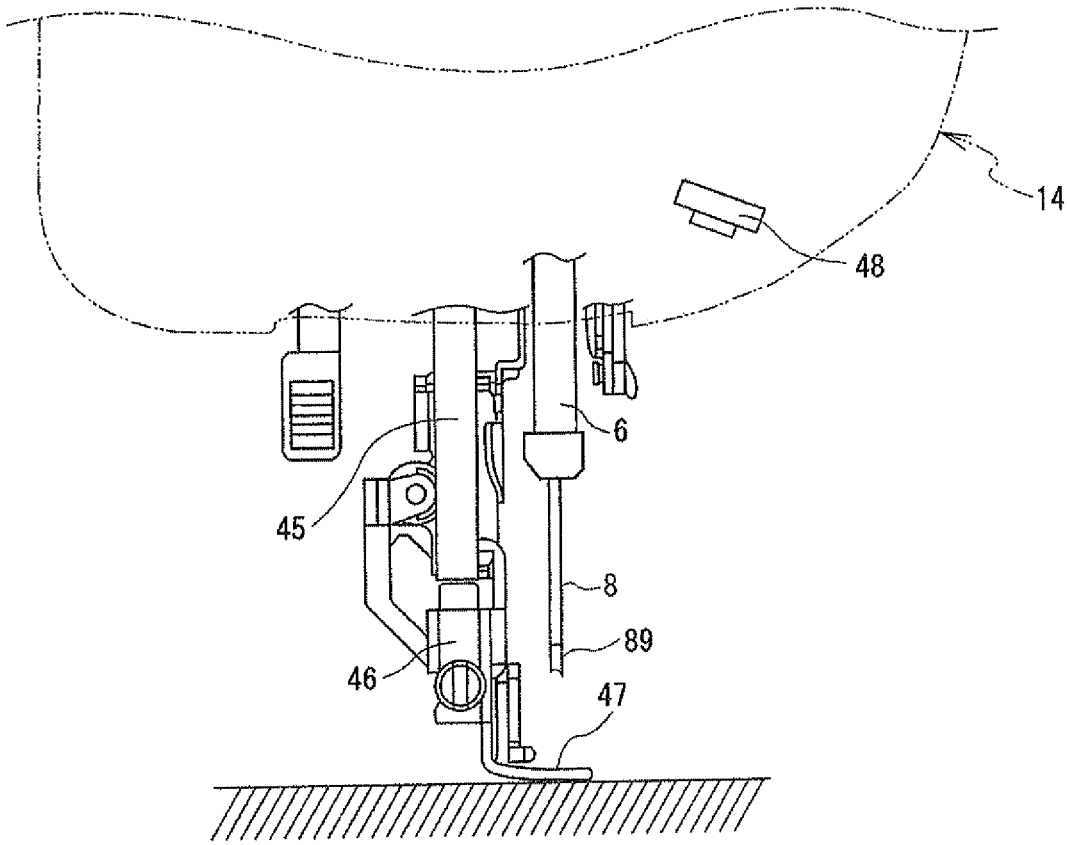
FIG. 3 is a figure that shows the needle bar 6 to which a cutwork needle 8 is attached, and the area around the needle bar 6, as seen from the left side of the sewing machine 1.

The outwork needle 8 will be explained. As shown in FIG. 3, a cutting portion 89 is formed at the tip of the outwork needle 8. The cutting portion 89 has a sharp-pointed shape (not shown in the drawings) in a front view and has a specified width in the front-rear direction (the left-right direction in FIG. 3) in a side view. The front edge of the cutting portion 89 extends slightly lower than does the rear edge. The portion of the cutting portion 89 from the front edge to the rear edge is curved slightly upward. When the outwork operation is performed with the outwork needle 8, a out that extends in the front-rear direction is formed in the work cloth 100. The length of the cut is the same as the width of the cutting portion 89 of the outwork needle 8. The outwork operation can be performed when the outwork needle 8 is attached to the lower end of the needle bar 6. The embroidery sewing operation can be performed when the sewing needle 7 is attached to the lower end of the needle bar 6, as shown in FIG. 2.

Figure 4:
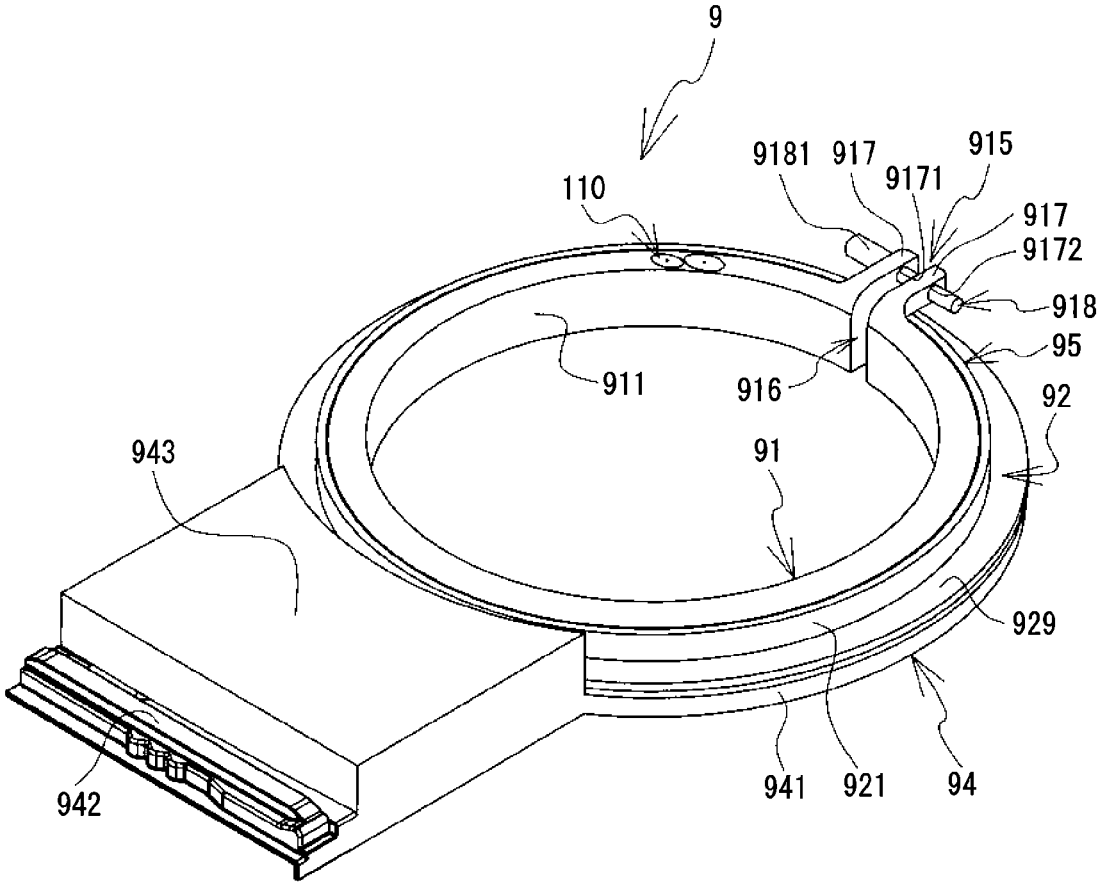
FIG. 4 is an oblique view of the embroidery frame 9.
Figure 5:
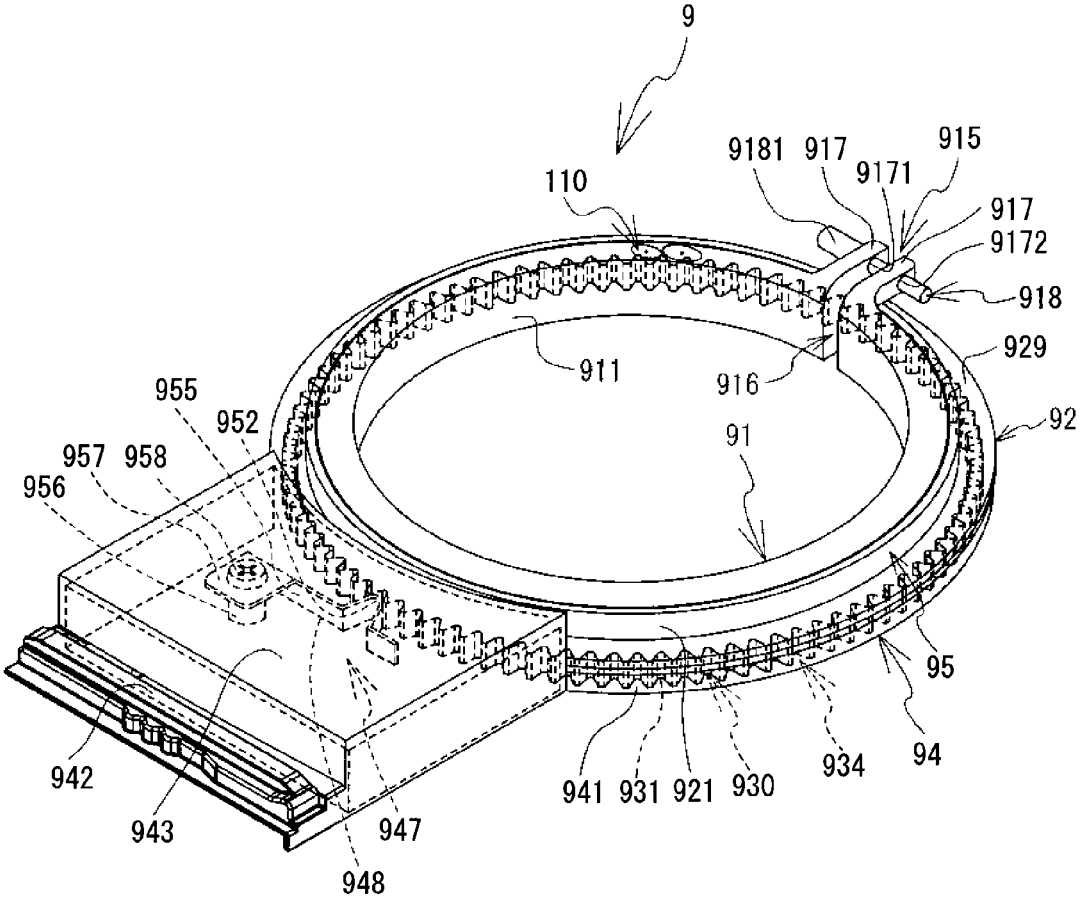
FIG. 5 is an oblique view that shows an internal structure of the embroidery frame 9 that is shown in FIG. 4.
Figure 6:
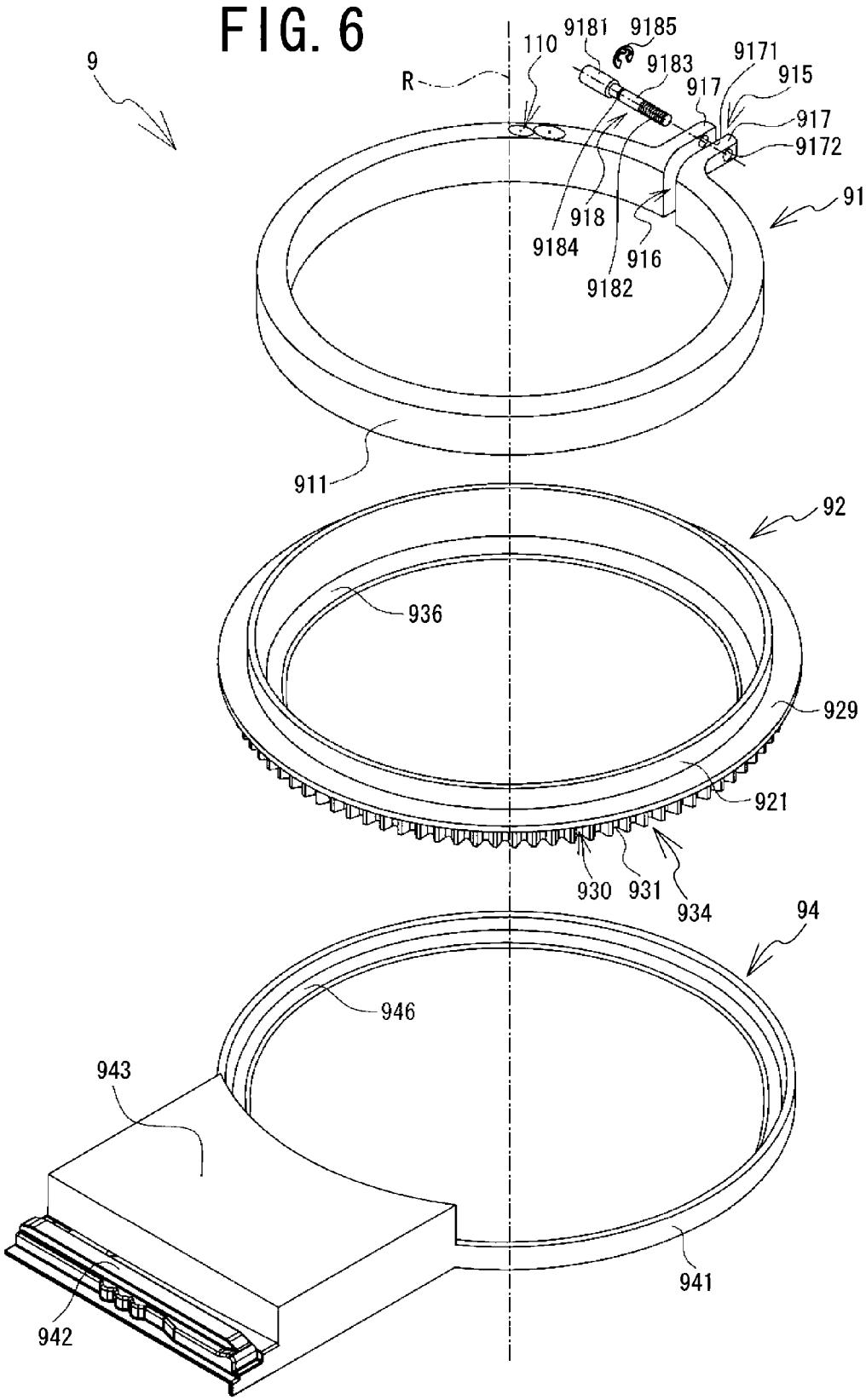
FIG. 6 is an exploded oblique view of the embroidery frame 9.

The embroidery frame 9 will be explained with reference to FIGS. 4 to 7. In the explanation that follows, the up-down direction in FIGS. 4 and 5 is defined as the up-down direction of the embroidery frame 9. As shown in FIGS. 4 to 6, the embroidery frame 9 is formed by combining an inner frame 91, a middle frame 92, and an outer frame 94, each of which has a circular frame shape. As shown in FIG. 4, in the embroidery frame 9, the middle frame 92 is disposed to the outside of the inner frame 91 in the radial direction. The outer frame 94 is disposed to the outside of the middle frame 92 in the radial direction. The embroidery frame 9 is configured to clamp the work cloth 100 between the inner frame 91 and the middle frame 92 and has a structure in which the inner frame 91 and the middle frame 92 can rotate in relation to the outer frame 94. The inner frame 91 and the middle frame 92 can be rotated about a rotational axis R shown in FIG. 6, in relation to the outer frame 94. Note that, in the embroidery frame 9 according to the present embodiment, the rotational axis R passes thorough the center of each circle that is formed by each of the inner frame 91, the middle frame 92, and the outer frame 94 (specifically, frame portions 911, 921, and 941, which are described below). Hereinafter, the direction of the rotational axis R is simply referred to as an "axial direction".

As shown in FIGS. 4 to 6, the inner frame 91 includes a circular frame portion 911. The frame portion 911 has thicknesses in the axial direction and the radial direction. The inner frame 91 includes an adjustment portion 915 that can adjust the diameter of the inner frame 91. The diameter of inner frame 91 may be adjusted according to the thickness of the work cloth 100 that is clamped between the inner frame 91 and the middle frame 92. The adjustment portion 915 includes a parting portion 916, a pair of screw mounting portions 917, and an adjusting screw 918. The parting portion 916 is a location where a portion in the circumferential direction of the frame portion 911 of the inner frame 91 is discontinuous through the axial direction. The pair of the screw mounting portions 917 are provided in upper portions of the frame portion 911 on both sides of the parting portion 916. The pair of the screw mounting portions 917 project to the outside in the radial direction and are positioned opposite one another. The pair of the screw mounting portions 917 are provided with holes 9171, 9172 that are through-holes in a direction that is orthogonal to the faces of the screw mounting portions 917 that are opposite one another (refer to FIG. 6). Of the two holes 9171, 9172, the hole 9172 (the hole on the lower right in FIG. 6) is provided with an embedded nut (not shown in the drawings) in which a threaded hole is formed.

The adjusting screw 918 is a threaded member that includes a large-diameter head portion 9181, which the user may rotate by gripping with his fingers, and a small-diameter shall portion 9183 that extends as a single piece from the head portion 9181. A male threaded portion 9182 is formed from roughly the center of the axial direction of the shaft portion 9183 to the tip. A narrow groove 9184 is formed in the shaft portion 9183 in a location that is close to the head portion 9181. A retaining ring 9185 may be fitted into the narrow groove 9184. The adjusting screw 918 may be mounted by passing the shaft portion 9183 through the hole 9171 and screwing the male threaded portion 9182 into the threaded hole in the embedded nut in the hole 9172. In this state, with the retaining ring 9185 fitted into the narrow groove 9184 of the shaft portion 9183, the adjusting screw 918 can be held such that it can rotate in the screw mounting portion 917 on the side where the hole 9171 is located and cannot move in the axial direction. At this time, if the user grips the head portion 9181 of the adjusting screw 918 with his fingers and performs a rotation operation, the screw mounting portion 917 on the side where the hole 9172 is located moves through the embedded nut in the axial direction of the shaft portion 9183. The direction of that movement is determined by the direction of rotation of the adjusting screw 918. In this way the adjusting screw 918 may be coupled with the pair of the screw mounting portions 917 and adjust the gap between the pair of the screw mounting portions 917 such as to make the gap wider or narrower. The adjusting of the gap between the pair of the screw mounting portions 917 adjusts the diameter of the inner frame 91 in accordance with the thickness of the work cloth 100. For example, to the extent that the gap between the pair of the screw mounting portions 917 becomes narrower, the diameter of the inner frame 91 becomes smaller. Therefore, the embroidery frame 9 is able to clamp the work cloth 100 that has a greater thickness between the middle frame 92 and the inner frame 91. Note that, for ease of explanation, the retaining ring 9185 is omitted from all of the drawings except FIG. 6.

Figure 7:
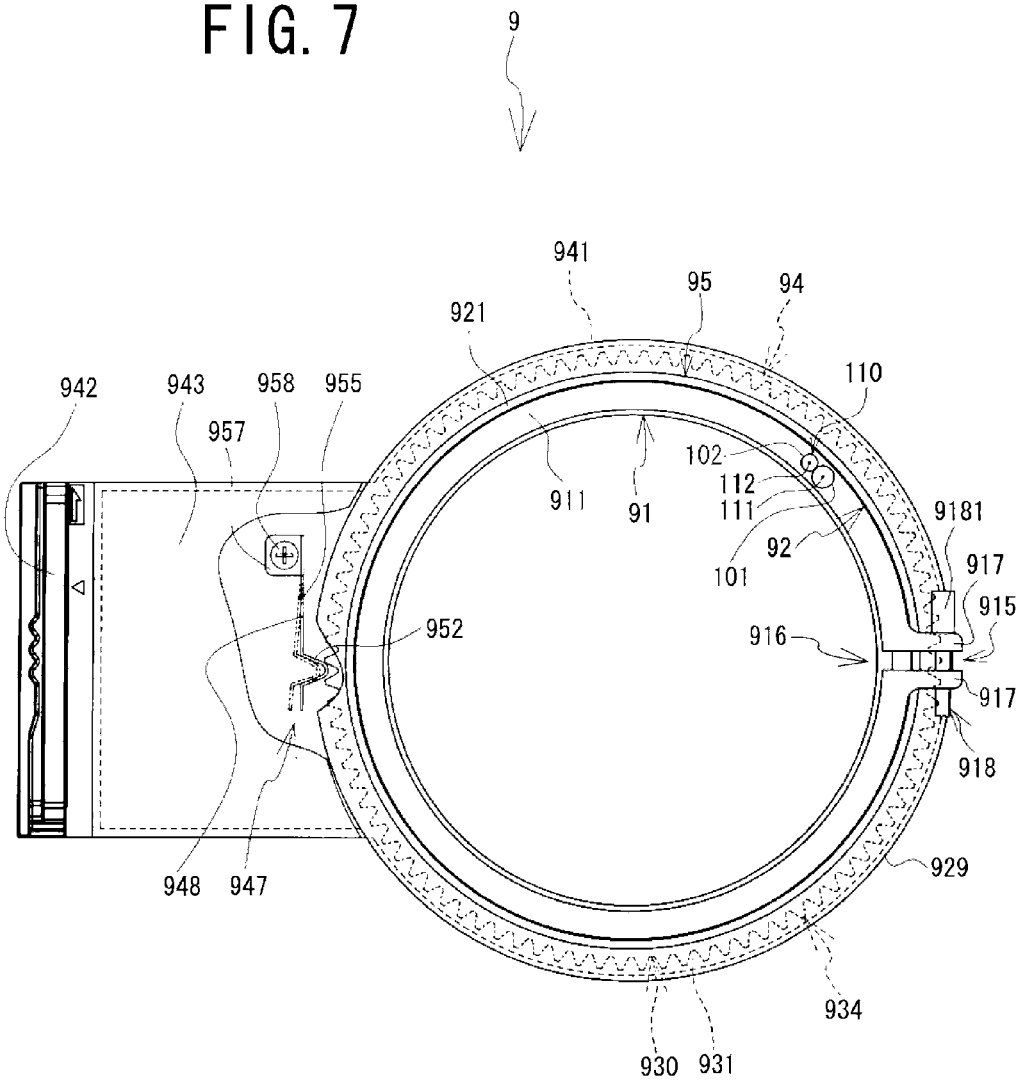
FIG. 7 is a plan view of the embroidery frame 9.

A marker 110 is provided on an edge face on the top side of the inner frame 91. As shown in FIG. 7, the marker 110 is provided by the drawing of a first circle 101, a second circle 102, a first center point 111, and a second center point 112 on the edge face on the to side of the inner frame 91. The second circle 102 and the first circle 101 are contiguous with one another in the circumferential direction of the inner frame 91. The diameter of the second circle 102 is smaller than the diameter of the first circle 101. The first center point 111 is in the center of the first circle 101. The second center point 112 is in the center of the second circle 102.

As shown in FIGS. 4 to 6, the middle frame 92 includes a circular frame portion 921. The frame portion 921 has an inside diameter that is larger than the outside diameter of the frame portion 911 of the inner frame 91. The middle frame 92 may be removably mounted on the inner frame 91 by removably mounting the frame portion 921 of the middle frame 92 on the outer side of the frame portion 911 of the inner frame 91 in the radial direction. As shown in FIGS. 5 to 7, a plurality of first engaging portions 930 are provided on the outer circumferential side face of the lower edge portion of the frame portion 921 of the middle frame 92. The first engaging portions 930 are made up of a plurality of recessed portions 931, each of which is formed approximately in the shape of a V. The plurality of the recessed portions 931 are formed at intervals of a specified angle, for example, every four degrees, around the entire outer circumferential side face of the tower edge portion of the frame portion 921 of the middle frame 92. In their entirety, the plurality of the first engaging portions 930 are formed in the shape of a gear. Hereinafter, the portion of the middle frame 92 where the plurality of the first engaging portions 930 form the gear shape is called a gear portion 934. The middle frame 92 can be locked to the outer frame 94 at one of a plurality of predetermined rotation angles (for example, one rotation angle every four degrees) by engaging a second engaging portion 947, which will be described later, with one of the plurality of the recessed portions 931.

A flange portion 929 is provided in a central portion in the axial direction of the outer circumferential side face of the frame portion 921, on the upper side of the gear portion 934. The flange portion 929 projects to the outside in the radial direction around the entire circumference of the frame portion 921. A support portion 936 is provided on an inner circumferential side face of the lower edge of the frame portion 921. The support portion 936 projects to the inside in the radial direction around the entire circumference of the frame portion 921. The support portion 936 is a portion that supports a lower edge face of the inner frame 91.

As shown in FIGS. 4 to 6, the outer frame 94 includes a circular frame portion 941. A support portion 946 that projects to the inside in the radial direction around the entire circumference of the frame portion 941 is provided on an inner circumferential side face of the lower edge of the frame portion 941. The support portion 946 is a portion that supports a lower edge face of the middle frame 92. The attachment portion 942 is provided on the outer side of the frame portion 941 in the radial direction. The embroidery frame 9 may be affixed to the sewing machine 1 (refer to FIG. 1) by mounting the attachment portion 942 on the mounting portion 351 of the card age (refer to FIG. 1).

A box-shaped coupling portion 943 is provided between the frame portion 941 and the attachment portion 942. The coupling portion 943 couples the frame portion 941 and the attachment portion 942. As shown in FIGS. 5 and 7, the interior of the coupling portion 943 is hollow. The second engaging portion 947 is provided in the coupling portion 943 near the edge on the side of the frame portion 941 (the side that faces toward the middle frame 92). In the present embodiment, the second engaging portion 947 is a flat spring 948.

As shown in FIG. 5, a threaded attachment portion 956 that projects upward from a bottom face of the coupling portion 943 is provided inside the coupling portion 943. A threaded hole (not shown in the drawings) is formed in the threaded attachment portion 956. A base end portion 957 of the flat spring 948 is disposed on the top side of the threaded attachment portion 956. A hole (not shown in the drawings) is provided in the center of the base end portion 957. The base end portion 957 of the flat spring 948 is affixed to the threaded attachment portion 956 by attaching a screw 958, which passes through the hole, to the threaded attachment portion 956.

A free end portion 955 extends from the base end portion 957 of the flat spring 948. As shown in FIG. 7, the free end portion 955 is bent downward (refer to FIG. 5) at the right edge (the right side in FIG. 7) of the base end portion 957 and extends toward the front (toward the bottom of FIG. 7). A protruding portion 952 is provided at the front end of the free end portion 955. The protruding portion 952 is formed approximately in the shape of a V, such that it protrudes toward the middle frame 92. The tip of the protruding portion 952 is able to engage with one of the plurality of the recessed portions 931. At that time, the elastic force of the flat spring 948 energizes the protruding portion 952 in such a direction that the tip of the protruding portion 952 presses against the recessed portion 931.

The engaging of the tip of the protruding portion 952 with one of the plurality of the recessed portions 931 and its pressing against the recessed portion 931 by the elastic force of the flat spring 948 can lock the middle frame 92 such that it cannot be rotated in relation to the outer frame 94. In a case where the user rotates the middle frame 92 in relation to the outer frame 94, one of the oblique faces of the recessed portion 931 (one of the oblique faces of the V shape) pushes the protruding portion 952 in a direction in which the protruding portion 952 is separated from the middle frame 92, in opposition to the elastic force of the flat spring 948. At this time, the free end portion 955 of the flat spring 948 bends such that the engagement of the protruding portion 952 and the recessed portion 931 is released. Then the protruding portion 952 engages with the recessed portion 931 that is adjacent to the recessed portion 931 with which the protruding portion 952 has been engaged previously.

If the rotating of the middle frame 92 is continued further, the engaging and the releasing of the engagement of the protruding portion 952 with one of the recessed portions 931 are repeated. The plurality of the recessed portions 931 are provided at four-degree intervals, so the user is able to set the angle of rotation of the middle frame 92 in relation to the outer frame 94 at four-degree intervals.

The mode in which the inner frame 91, the middle frame 92, and the outer frame 94 are combined will be explained. First, the user may place the middle frame 92 on a desktop or the like such that the gear portion 934 that includes the first engaging portion 930 is on the bottom side. Then the user may insert the inner frame 91 into the inner side of the middle frame 92 from the top side of the middle frame 92, thus clamping the work cloth 100 between the inner frame 91 and the middle frame 92. At this time, the user, by adjusting the adjustment portion 915, may adjust the diameter of the inner frame 91 in accordance with the thickness of the work cloth 100. In the explanation that follows, the frame that is formed by the combining of the inner frame 91 and the middle frame 92 is called an assembled unit 95.

Next, the user may place the assembled unit 95 into the outer frame 94 from the top side of the outer frame 94. At this time, the user may place the assembled unit 95 into the frame portion 941 such that the protruding portion 952 engages with one of the plurality of the recessed portions 931. When the assembled unit 95 is placed into the outer frame 94, a state is created in which the protruding portion 952 is engaged with one of the recessed portions 931. Thus the second engaging portion 947 and the first engaging portion 930 may be engaged, and the rotation of the middle frame 92 (the assembled unit 95) may be locked in relation to the outer frame 94. The inner frame 91, the middle frame 92, and the outer frame 94 can be combined as described above, to obtain the completed form of the embroidery frame 9. Then the user may attach the completed form of the embroidery frame 9 to the carriage of the moving unit 19 that is mounted on the sewing machine 1 (refer to FIG. 1). The user is able to rotate and lock the middle frame 92 (the assembled unit 95) in relation to the outer frame 94.

An electrical configuration of the sewing machine 1 will be explained with reference to FIG. 8. As shown in FIG. 8, a control portion 60 of the sewing machine 1 includes a CPU 61, a ROM 62, a RAM 63, an EEPROM 64, and an input/output interface 65, all of which are connected to one another by a bus 67. Programs for the performing of processing by the CPU 61, as well as data and the like, are stored in the ROM 62.

The EEPROM 64 includes at least a outwork data storage area 641. A plurality of outwork data tables, an example of which is a outwork data table 59 (refer to FIG. 9), are stored in the cutwork data storage area 641. A plurality of embroidery data sets for the performing of embroidery sewing by the sewing machine 1 are also stored in the EEPROM 64.

The sewing start/stop switch 21, the touch panel 26, and drive circuits 71, 72, 75, 85, 86, and 87 are electrically connected to the input/output interface 65. The drive circuit 71 may drive the feed adjustment pulse motor 78. The drive circuit 72 may drive the sewing machine motor 79. The drive circuit 75 may drive the liquid crystal display 15. The drive circuits 85 and 86 may respectively drive the X axis motor 83 and the axis motor 84 that move the embroidery frame 9. The drive circuit 87 may drive the image sensor 48. By controlling the image sensor 98, the CPU 61 (refer to FIG. 8) can capture an image of the area that includes the embroidery frame 9 that is mounted on the mounting portion 351.

The outwork data table 59 will be explained with reference to FIG. 9. The cutwork data table 59 that is shown in FIG. 9 contains data for cutting out a plurality of areas 107 on inner sides of a plurality of flower petal patterns 106 in a flower pattern 105 (refer to FIG. 12) that has been embroidered in the work cloth 100. The cutwork data table 59 may be stored in the outwork data storage area 641 (refer to FIG. 8).

As shown in FIG. 9, columns are provided in the outwork data table 59 for a variable N, frame rotation data, an X coordinate, and a Y coordinate, and data may be stored in association with each of the items. The variable N is a variable that indicates an order in which a cut is formed in the work cloth 100. The frame rotation data are data that indicate predetermined rotation angles of the middle frame 92 in relation to the outer frame 94. The X coordinate and the Y coordinate are coordinates for predetermined needle drop points. Note that in the present embodiment, the coordinates at the center of the embroidery frame 9 in an image 151 that will be described later (refer to FIG. 12) are defined as the coordinates of the origin point (X coordinate 0, Y coordinate 0), with the coordinate in the left-right direction defined as the X coordinate and the coordinate in the up-down direction defined as the Y coordinate (refer to FIG. 12). In a case where the areas 107 on the inner sides of the flower petal patterns 106 are cut out, the middle frame 92 is rotated, in relation to the outer frame 94, to each of the rotation angles based on the frame rotation data, in the order of the variables N 1 to 221. A cut is formed in the work cloth 100 by using the outwork needle 8 at each needle drop point that is defined by the X coordinate and the Y coordinate for the corresponding variable N.

Figure 10:
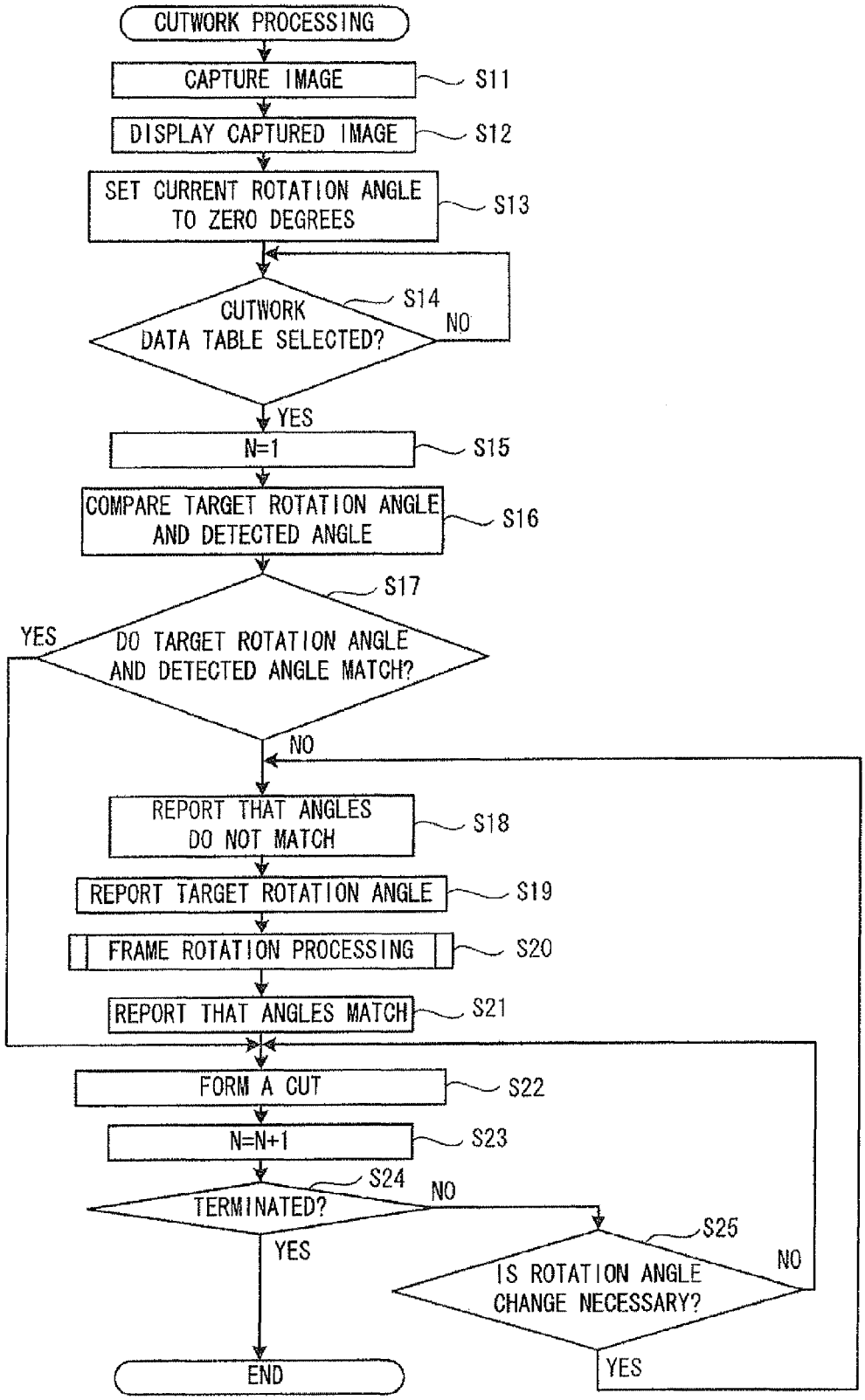
FIG. 10 is a flowchart of cutwork processing.
Figure 11:
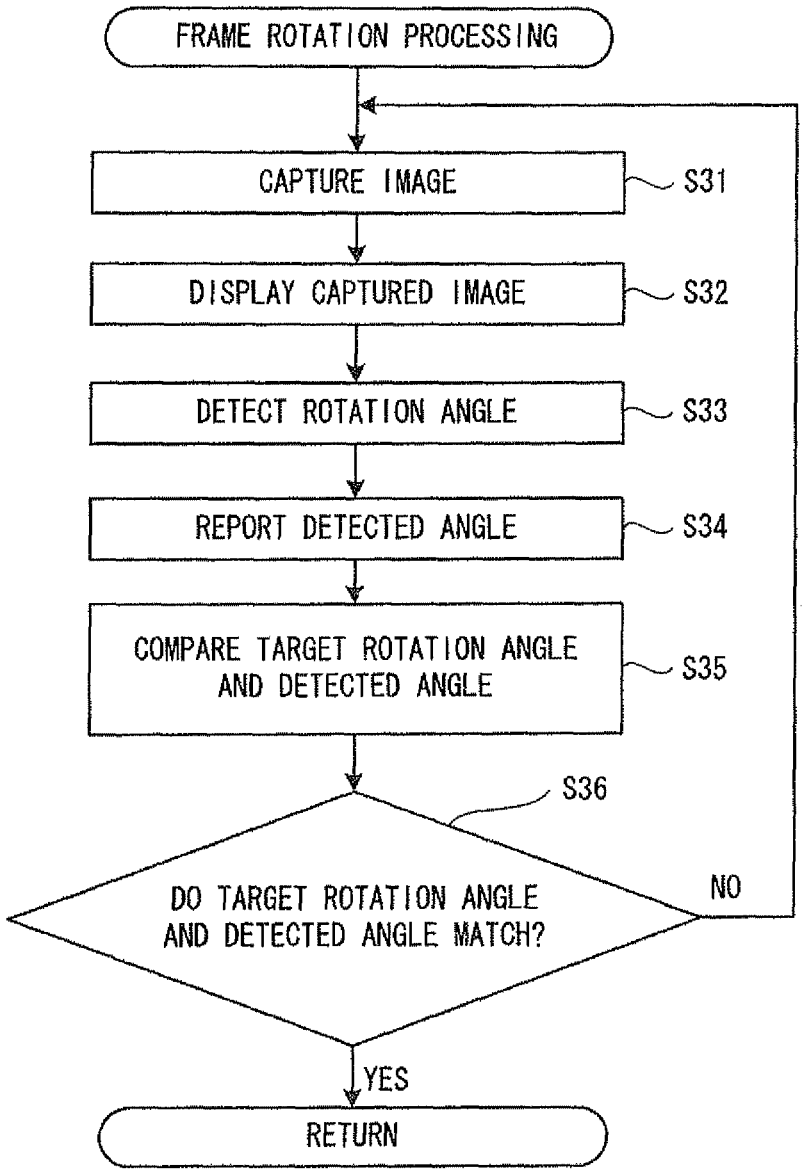
FIG. 11 is a flowchart of frame rotation processing.
Figure 12:
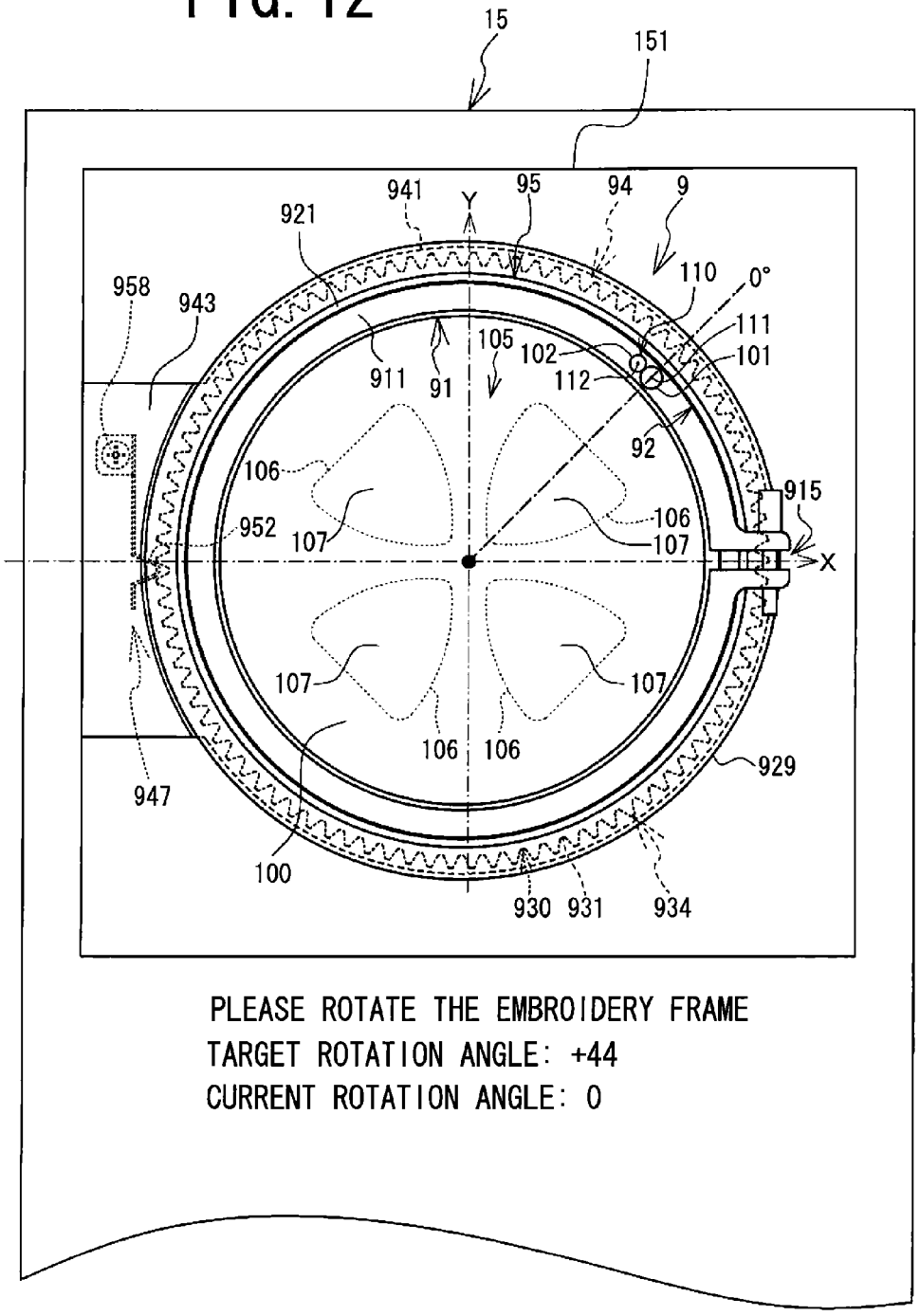
FIG. 12 is a figure that shows an example of an image that is displayed on a liquid crystal display 15.

Cutwork processing that is performed by the CPU 61 of the sewing machine 1 will be explained with reference to FIGS. 10 to 14. In the explanation that follows, a case in which a outwork of the flower pattern 105 is created by cutting out the areas 107 on the inner sides of the four flower petal patterns 106 that are shown in FIG. 12 will be explained as a specific example.

In the specific example, when the areas 107 on the inner sides of the four flower petal patterns 106 are to be cut out, the user attaches the cutwork needle 8 to the needle bar 6 (refer to FIG. 3). The orientation of the cutting portion 89 of the outwork needle 8 is fixed such that the cutting portion 89 extends in the front-rear direction, as shown in FIG. 3. Therefore, in order to cut all four of the areas 107 out of the work cloth 100, it is necessary to form cuts along the outlines of the inner sides of the flower petal patterns 106 as the rotation angle of the middle frame 92 (the assembled unit 95) is changed in relation to the outer frame 94. Accordingly, the user performs a panel operation to cause the sewing machine 1 to perform the outwork processing, which causes the sewing machine 1 to cut out the areas 107 while changing the rotation angle of the middle frame 92 (the assembled unit 95) in relation to the outer frame 94. In the outwork processing, various types of information are reported to the user so that the user can adjust the rotation angle of the middle frame 92 in relation to the outer frame 94 to a specified rotation angle. In the explanation that follows, the information for adjusting the rotation angle of the middle frame 92 in relation to the outer frame 94 to the specified rotation angle is called rotation information.

When a command to perform the cutwork processing is input by the panel operation. The CPU 61 of the sewing machine 1 reads out a program for the cutwork processing that is stored in the ROM62. The CPU61 performs the cutwork processing in accordance with instructions included in the program that is read out from the ROM62. As shown in FIG. 10, in the cutwork processing after the embroidery frame 9 has been moved to an initial position where the center of the embroidery frame 9 is the needle drop point, the image sensor 48 is controlled such that the image 151, which includes the area that includes the embroidery frame 9 that is mounted on the mounting portion 351, is captured (Step S11). The image 151 that is captured at Step S11 is displayed on the liquid crystal display 15 (Step S12). An example of the displayed image 151 is shown in FIG. 12. Note that for the purpose of the explanation, only a portion of the work cloth 100 that resides on the inner side of the inner frame 91 is shown in FIG. 12 (the same is true for FIGS. 13 and 14).

The marker 110 that is provided on the embroidery frame 9 is identified based on the image 151, the rotation angle of the middle frame 92 in relation to the outer frame 94 is detected based on the identified marker 110, and the detected rotation angle is set to zero degrees (0°) (Step S13). For example, in a case where the image 151 that is shown in FIG. 12 is captured, the marker 110 that is provided on the embroidery frame 9 is identified. Any known method may be used for identifying the marker 110. For example, the method may be used that is described in Japanese Laid-Open Patent Publication No. 2009-172123, the relevant portion of which is hereby incorporated by reference. The detected rotation angle is then set as zero degrees, by storing in the RAM 63, as a zero-degree line, a virtual line that links the origin point (the center position of the embroidery frame 9) to the coordinate position of the first center point 111 of the first circle 101 (Step S13). In the explanation that follows, the rotation angle of the middle frame 92 in relation to the outer frame 94 that is detected at one of Steps S13 and S34 (described later) is called the detected angle. At Step S13, the detected angle is zero degrees. In the explanation that follows, the clockwise direction from the detected angle of zero degrees in FIG. 12 is expressed as positive (+), and the counterclockwise direction from the detected angle of zero degrees is expressed as negative (−).

A determination is made as to whether or not one of the outwork data tables that are stored in the EEPROM 64 is selected by the user (Step S14). At Step S14, a plurality of outwork patterns are displayed on the liquid crystal display 15. The user selects one of the outwork patterns by performing the panel operation. When one of the outwork patterns is selected by the user, a determination is made that the corresponding one of the outwork data tables is selected (YES at Step S14). In a case where none of the outwork data tables is selected (NO at Step S14), the processing returns to Step S14. In the specific example, the cutwork data table 59 (refer to FIG. 9) for cutting out the areas 107 on the inner sides of the flower petal patterns 106 is selected.

In a case where the cutwork data table 59 is selected (YES at Step S14), the variable N is set to 1 and is stored in the RAM 63 (Step S15). The detected angle that was detected at Step S13 is compared to the rotation angle (hereinafter called the target rotation angle) that is based on the frame rotation data that correspond to the variable N in the outwork data table 59 (Step S16). A determination is made as to whether or not the result of the comparison is that the detected angle matches the target rotation angle (Step S17). In a case where the detected angle matches the target rotation angle (YES at Step S17), the processing advances to Step S22 (described later).

In the specific example, a determination is made that the detected angle of zero degrees does not match the target rotation angle of +44 degrees that corresponds to the variable N 1 (refer to FIG. 9) (NO at Step S17). In a ease where the detected angle does not match the target rotation angle (NO at Step S17), information that indicates that the detected angle does not match the target rotation angle is reported as rotation information (Step S18). At Step S18, a message that says, for example, "Please rotate the embroidery frame" is displayed on the liquid crystal display 15 (refer to FIG. 12). The user is thus able to know that it is necessary to rotate the embroidery frame 9. In other words, the user is able to know that the detected angle does not match the target rotation angle.

The rotation angle (the target rotation angle) that is based on the frame rotation data is reported as rotation information (Step S19). At Step S19, a message that says, for example, "Target rotation angle: +44°" is displayed on the liquid crystal display 15 (refer to FIG. 12). The user is thus able to recognize that the embroidery frame 9 needs to be rotated to +44 degrees. Next, frame rotation processing is performed (Step S20).

The frame rotation processing will be explained with reference to FIG. 11. The frame rotation processing is processing for assisting the user in adjusting the rotation angle of the middle frame 92 in relation to the outer frame 94 to the target rotation angle by rotating the middle frame 92 (the assembled unit 95). As shown in FIG. 11, in the frame rotation processing, the image sensor 48 is controlled in the same manner as at Step S11 (refer to FIG. 10), such that the image 151, which includes the area that includes the embroidery frame 9 that is mounted on the mounting portion 351, is captured (Step S31). The captured image 151 is displayed on the liquid crystal display 15 (Step S32). The marker 110 that is provided on the embroidery frame 9 is identified based on the captured image 151, and the rotation angle of the middle frame 92 in relation to the outer frame 94 is detected based on the identified marker 110 (Step S33).

The detected angle is reported as rotation information (Step S34). At Step S34, the detected angle is displayed on the liquid crystal display 15, for example. The user is thus able to accurately recognize the current rotation angle. In the specific example, the initial detected angle is zero degrees, so a message that says, for example, "Current rotation angle: 0°" is displayed on the liquid crystal display 15 (refer to FIG. 12).

In the same manner as at Step S16 (refer to FIG. 10), the detected angle is compared to the target rotation angle (Step S35). In the same manner as at Step S17 (refer to FIG. 10), a determination is made as to whether or not the result of the comparison is that the detected angle matches the target rotation angle (Step S36). In a case where the detected angle does not match the target rotation angle (NO at Step S36), the processing returns to Step S31. That is, the processing at Steps S31 to S36 is repeated until the user rotates the middle frame 92 in relation to the outer frame 94 such that the detected angle matches the target rotation angle. The repeating of Steps S31 to S36 causes the image 151 of the embroidery frame 9 to be captured and displayed on the liquid crystal display 15 in real time (Steps S31 and S32) during the time that the user is adjusting the rotation angle of the middle frame 92. The current rotation angle (the detected angle) of the middle frame 92 in relation to the outer frame 94 is also displayed on the liquid crystal display 15 in real time (Step S34).

Figure 13:
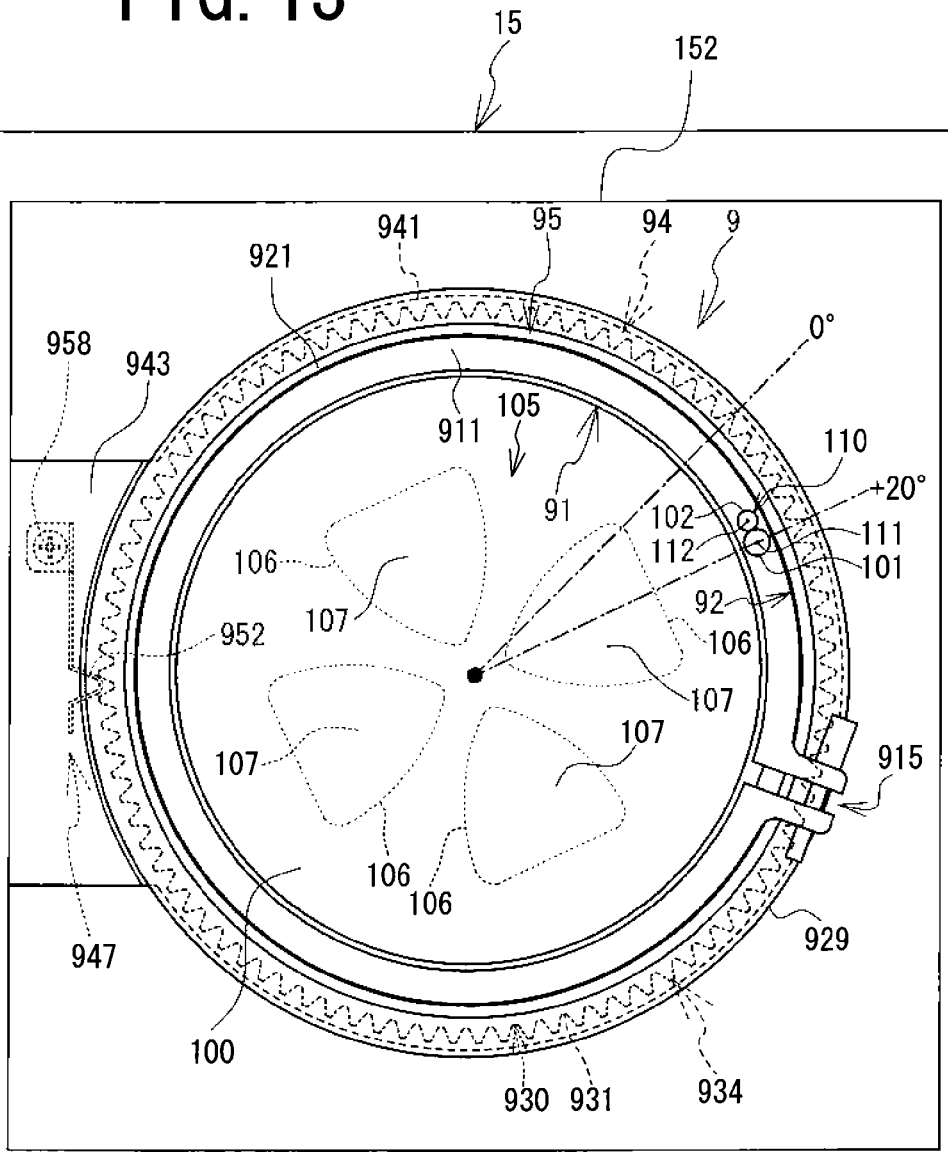
FIG. 13 is a figure that shows another example of an image that is displayed on the liquid crystal display 15.

For example, in a case where the user has rotated the middle frame 92 clockwise to the position of +20 degrees, an image 152, in which the middle frame 92 has been rotated to +20 degrees, and the message "Current rotation angle: +20°" are displayed on the liquid crystal display 15, as shown in FIG. 13. Because the current rotation angle (the detected angle) is displayed in this manner, the user is able to easily adjust the rotation angle of the middle frame 92 in relation to the outer frame 94 to the target rotation angle while checking the current rotation angle of the middle frame 92 in relation to the outer frame 94. When the middle frame 92 is rotated to the position of +44 degrees, as shown in an image 153 in FIG. 14, the determination is made that the detected angle matches the target rotation angle (YES at Step S36), the frame rotation processing is terminated, and the processing advances to Step S21 (refer to FIG. 10).

As shown in FIG. 10, at Step S21, information that indicates that the detected angle and the target rotation angle match is reported as rotation information (Step S21). At Step S21, the message "Rotation angle matches target rotation angle," for example, is displayed on the liquid crystal display 15. Thus the user can easily know that the rotation angle of the middle frame 92 in relation to the outer frame 94 matches the rotation angle (the target rotation angle) that is based on the frame rotation data.

Figure 14:
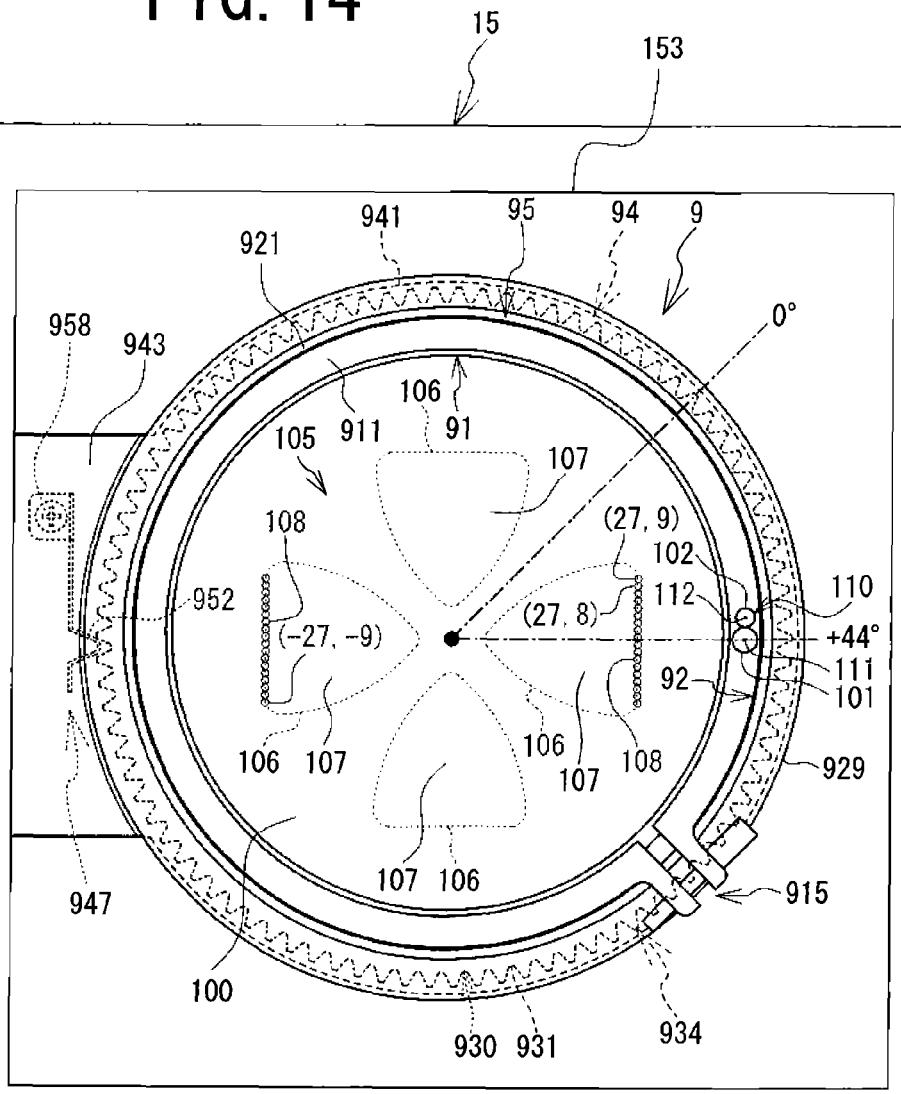
FIG. 14 is a figure that shows yet another example of an image that is displayed on the liquid crystal display 15.

Based on the data that corresponds to the value of the variable N, a cut is formed (Step S22). For example, in a case where the variable N in the outwork data table 59 is 1, the X coordinate is 27, and the Y coordinate is 9. Therefore, the X axis motor 83 and the Y axis motor 84 are driven, and the embroidery frame 9 is moved, such that the position specified by the X coordinate 27 and the Y coordinate 9 is the needle drop point. Then the needle bar 6 is driven, and a cut is formed by the outwork needle 8 at the position in the work cloth 100 that is specified by the X coordinate 27 and the Y coordinate 9 (refer to FIG. 14). In FIG. 14, white circles represent needle drop points 108 for the outwork needle 8 for forming cuts in the work cloth 100 when the rotation angle that is based on the frame rotation data is +44 degrees (when the variable N is from 1 to 38). In the present embodiment, the work cloth 100 is cut in the front-rear direction of the sewing machine 1 (the orientation of the cutting portion 89 of cutwork needle 8), such that the white circles are joined.

The variable N is incremented (Step S23). A determination is made as to whether or not the cutwork has been completed (Step S24). At Step S24, the determination as to whether or not the cutwork has been completed is made by determining whether or not data such as the frame rotation data and the like that correspond to the current value of the variable N exist in the outwork data table 59. For example, if the current variable N is 222, the data do no exist in the outwork data table 59, so the determination is made that the cutwork has been completed.

In a case where the outwork has not been completed (NO at Step S24), a determination is made as to whether or not it is necessary to change the rotation angle of the middle frame 92 in relation to the outer frame 94 (Step S25), the determination being made by determining whether or not the rotation angle that is based on the frame rotation data in the outwork data table 59 has changed. For example, as shown in the cutwork data table 59 (refer to FIG. 9), during the time that the variable N is from 1 to 38, the rotation angle that is based on the frame rotation data is +44 degrees and does not change. Thus, the determination is made that it is not necessary to change the rotation angle of the middle frame 92 in relation to the outer frame 94 (NO at Step S25), the processing returns to Step S22. The forming of the cuts is continued.

In the case where the variable N changes from 38 to 39, for example, the rotation angle that is based on the frame rotation data changes from +44 degrees to zero degrees (refer to FIG. 9). It is therefore determined that it is necessary to change the rotation angle of the middle frame 92 in relation to the outer frame 94 (YES at Step S25), and the processing returns to Step S18. Information that indicates that the detected angle does not match the target rotation angle (zero degrees) is reported as rotation information (Step S18), and the target rotation angle is reported (Step S19). Then, in the same manner as in the previously described case where the middle frame 92 was rotated from zero degrees to +44 degrees, the user rotates the middle frame 92 in relation to the outer frame 94 while referring to the image 151 of the embroidery frame 9 that is displayed at Step S32 and to the detected angle that is displayed at Step S34. The user adjusts the rotation angle of the middle frame 92 in relation to the outer frame 94 to the target rotation angle of zero degrees. Then, when the detected angle matches the target rotation angle of zero degrees (YES at Step S36), a cut is formed at the target rotation angle of zero degrees (Steps S22 to S23).

Thereafter, the forming of the cuts is continued by repeating the rotation of the middle frame 92 and forming of a cut in the work cloth 100. Then, when it is determined that the cutwork has been completed (YES at Step S24), the outwork processing is terminated. Thus the completed form of the flower pattern 105 is produced, in which all of the areas 107 have been cut out on the inner sides of the four flower petal patterns 106.

The cutwork processing in the present embodiment is performed as described above. In the present embodiment, rotation information is reported that is information for adjusting the rotation angle of the middle frame 92 to a specified angle based on the detected angle (Steps S18, S19, S21 in FIG. 10; Step S34 in FIG. 11). Therefore, the user is able to adjust the rotation angle of the middle frame 92 in relation to the outer frame 94 by referring to the reported rotation information. It is thus possible for the user to easily adjust the rotation angle of the middle frame 92 in relation to the outer frame 94 without being required to look at a graduated scale or markings, as with the known embroidery frame.

More specifically, the sewing machine 1 reports the rotation information based on the detected angle and the frame rotation data (Steps S18, S19 in FIG. 10). It is thus possible for the user to easily adjust the rotation angle of the middle frame 92 in relation to the outer frame 94 by referring to the rotation information that is reported. Accordingly, the user is able to adjust the rotation angle of the middle frame 92 in relation to the outer frame 94 even more easily.

The sewing machine 1 is able to report the rotation information in a case where the detected angle matches the rotation angle (the target rotation angle) that is based on the frame rotation data (Step S21). It is thus possible for the user to easily know that the rotation angle of the middle frame 92 in relation to the outer frame 94 matches the rotation angle that is based on the frame rotation data. Accordingly, the user is able to easily adjust the rotation angle of the middle frame 92 in relation to the outer frame 94.

The sewing machine 1 is able to report the rotation information in a case where the detected angle does not match the rotation angle (the target rotation angle) that is based on the frame rotation data (Step S18). It is thus possible for the user to easily adjust the rotation angle of the middle frame 92 in relation to the outer frame 94 such that the rotation angle matches the rotation angle that is based on the frame rotation data.

The sewing machine 1 is able to report the rotation angle that is based on the frame rotation data as the rotation information (Step S19). The user is therefore able to easily know the rotation angle (the target rotation angle) that is based on the frame rotation data. Thus the angle that is the target can be made clear, and the rotation angle of the middle frame 92 in relation to the outer frame 94 can be matched to it efficiently.

The sewing machine 1 is able to report the detected angle that is detected at Step S33 as the rotation information (Step S34). It is thus possible for the user to easily know the current rotation angle of the middle frame 92 in relation to the outer frame 94. Accordingly, the user is able to adjust the rotation angle of the middle frame 92 in relation to the outer frame 94 while referring to the detected angle that has been reported.

The sewing machine 1 is able to display the detected angle (Step S34) while also displaying the target rotation angle (Step S19). It is therefore possible for the user to easily know that the current rotation angle of the middle frame 92 in relation to the outer frame 94 does not match the target rotation angle. It is also possible for the user to adjust the rotation angle of the middle frame 92 in relation to the outer frame 94 even more easily by referring to the current rotation angle of the middle frame 92 in relation to the outer frame 94 and to the target rotation angle at the same time.

In a case where the detected angle matches the rotation angle (the target rotation angle) that is based on the frame rotation data (YES at Step S17 or YES at Step S36), the needle bar 6 is driven, and the cutting is performed (Step S22). In a case where the detected angle does not match the rotation angle (the target rotation angle) that is based on the frame rotation data (NO at Step S17 or NO at Step S36), the processing at Step S22 is not performed, and the cutting of the work cloth 100 is not performed. Therefore, it is possible to prevent the work cloth 100 from being out by mistake in a case where the detected angle does not match the rotation angle that is based on the frame rotation data.

Because the rotation information is displayed on the liquid crystal display 15 (Steps S18, S19, S21 in FIG. 10; Step S34 in FIG. 11), the user can easily know the rotation information by checking the liquid crystal display 15. The convenience for the user can be thus improved.

Note that the present disclosure is not limited to the embodiment that has been described above, and various types of modifications can be made. For example, the rotation information is reported to the user by being displayed on the liquid crystal display 15 (Steps S18, S19, S21 in FIG. 10; Step S34 in FIG. 11), but the present disclosure is not limited to this example. For example, one of a light emitting diode (LED) and a lamp may be provided, and in a case where the detected angle matches the target rotation angle, in a case where the detected angle does not match the target rotation angle, and the like, information may be reported to the user by causing the one of the LED and the lamp to one of turn on and flash. Information may be reported to the user by changing the color of the one of the LED and the lamp. In this case as well, the user is able to easily match the rotation angle of the middle frame 92 in relation to the outer frame 94 to the rotation angle that is based on the frame rotation data by adjusting the rotation angle while checking the one of the LED and the lamp. The sewing machine 1 may also be provided with one of a speaker and a buzzer, and information may be reported to the user in the form of sound.

In the embodiment the marker 110 is provided on the inner frame 91 of the embroidery frame 9 in the form of drawing, but the present disclosure is not limited to this example. For example, the marker 110 may be drawn on one face of a sheet of a specified size, and an adhesive is applied to the other face of the sheet. The sheet may then be affixed to the work cloth 100 that is clamped between the inner frame 91 and the middle frame 92. In this case, the rotation angle of the middle frame 92 in relation to the outer frame 94 can be detected (Steps S13 and S33) based on the marker 110 that has been affixed to the work cloth 100.

The embroidery frame 9 is not limited to the case of the present embodiment, and an embroidery frame that has a different structure may also be used, as long as it is a rotatable embroidery frame. For example, it is possible to use an embroidery frame that includes a frame member that is configured to hold the work cloth 100 and an outer frame that is configured such that it can be removably mounted on the outer side of the frame member and that is configured to rotatably hold the frame member.

It is not necessary for all of the rotation information that is described in the embodiment to be reported, and only a portion of the rotation information may be reported. The frame rotation data are used in the reporting of the rotation information in the embodiment, but the present disclosure is not limited to this example. For example, it is acceptable to report only the current rotation angle of the middle frame 92, based only on the detected angle, without using the frame rotation data.

A specific example has been explained of an embodiment in which the middle frame 92 is rotated in relation to the outer frame 94 when the outwork is performed, but the present disclosure is not limited to this example. For example, the reporting of the rotation information and other procedures that are described above may also be performed in a case where the middle frame 92 is rotated in relation to the outer frame 94 while embroidery sewing is being performed with the sewing needle 7 (refer to FIG. 2).

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a mounting portion configured to be mounted with an embroidery frame, wherein the embroidery frame comprises a frame configured to hold a work cloth and an outer frame configured to be detachably attached to an outside of the frame and configured to rotatably hold the frame;

an image capturing device configured to capture an image including the embroidery frame mounted to the mounting portion;

a display device configured to display the captured image and rotation information;

a processor configured to execute instructions;

a memory configured to store computer-readable instructions and frame rotation data therein, wherein the computer-readable instructions instruct the processor to execute steps comprising:

identifying a mark from the image captured by the image capturing device, wherein the mark is provided on the embroidery frame or on the work cloth;

determining a rotation angle of the frame with respect to the outer frame based on the identified mark; and notifying the determined rotation angle and a predetermined rotation angle as the rotation information by displaying together on the display device, wherein the frame rotation data being data representing the predetermined rotation angle of the frame with respect to the outer frame, and the rotation information being information for adjusting the rotation angle to a specified rotation angle.

2. The sewing machine according to claim 1, wherein the computer-readable instructions instruct the sewing machine to execute steps further comprising:

determining whether the determined rotation angle matches the predetermined rotation angle which is represented by the frame rotation data, wherein notifying the rotation information comprises notifying information which represents that the determined rotation angle matches the predetermined rotation angle which is represented by the frame rotation data as the rotation information, in response to determining that the determined rotation angle matches the predetermined rotation angle.

3. The sewing machine according to claim 1, wherein the computer-readable instructions instruct the sewing machine to execute steps further comprising:

determining whether the determined rotation angle matches the predetermined rotation angle which is represented by the frame rotation data, wherein notifying the rotation information comprises notifying information which represents that the determined rotation angle does not match the predetermined rotation angle which is represented by the frame rotation data as the rotation information, in response to determining that the determined rotation angle does not match the predetermined rotation angle.

4. The sewing machine according to claim 1, further comprising:

a needle bar configured to attach a needle; and a driving device configured to drive the needle bar; wherein the computer-readable instructions instruct the sewing machine to execute steps further comprising:

determining whether the determined rotation angle matches the predetermined rotation angle which is represented by the frame rotation data; and starting to drive the needle bar by the driving device, in response to determining that the determined rotation angle matches the predetermined rotation angle.

5. A non-transitory computer-readable medium storing computer-readable instructions that, when executed, instruct a sewing machine, wherein the sewing machine comprises a mounting portion, an image capturing device, a display device, and a memory, wherein the mounting portion is configured to be mounted with an embroidery frame, wherein the embroidery frame comprises a frame configured to hold a work cloth and an outer frame configured to be detachably attached to an outside of the frame and configured to rotatably hold the frame, wherein the image capturing device is configured to capture an image including the embroidery frame mounted on the mounting portion, wherein the image capturing device configured to display the captured image and rotation information, and, wherein the display device configured to display the captured image and the rotation information, the computer-readable instructions instructing a processor of the sewing machine to execute steps comprising:

identifying a mark from the image captured by the image capturing device, wherein the mark is provided on the embroidery frame or on the work cloth;

determining a rotation angle of the frame with respect to the outer frame based on the identified mark; and notifying the determined rotation angle and a predetermined rotation angle as the rotation information by displaying together on the display device, wherein the frame rotation data being data representing the predetermined rotation angle of the frame with respect to the outer frame, and the rotation information being information for adjusting the rotation angle to a specified rotation angle.

6. The non-transitory, computer-readable medium according to claim 5, wherein the computer-readable instructions instruct the sewing machine to execute steps further comprising:

determining whether the determined rotation angle matches the predetermined rotation angle which is represented by the frame rotation data, wherein notifying the rotation information comprises notifying information which represents that the determined rotation angle matches the predetermined rotation angle which is represented by the frame rotation data as the rotation information, in response to determining that the determined rotation angle matches the predetermined rotation angle.

7. The non-transitory, computer-readable medium according to claim 5, wherein the computer-readable instructions instruct the sewing machine to execute steps further comprising:

determining whether the determined rotation angle matches the predetermined rotation angle which is represented by the frame rotation data, wherein notifying the rotation information comprises notifying information which represents that the determined rotation angle does not match the predetermined rotation angle which is represented by the frame rotation data as the rotation information, in response to determining that the determined rotation angle does not match the predetermined rotation angle.

8. The non-transitory, computer-readable medium according to claim 5, wherein the sewing machine further comprises a needle bar configured to attach a needle and a driving device configured to drive the needle bar, wherein the computer-readable instructions instruct the sewing machine to execute steps further comprising:

determining whether the determined rotation angle matches the predetermined rotation angle which is represented by the frame rotation data; and starting to drive the needle bar by the driving device, in response to determining that the determined rotation angle matches the predetermined rotation angle.

* * * * *